US007390159B2

(12) United States Patent
Rimsa et al.

(10) Patent No.: US 7,390,159 B2
(45) Date of Patent: Jun. 24, 2008

(54) FRONT MOUNTED LIFTER FOR FRONT LOAD VEHICLE

(75) Inventors: James Rimsa, Countryside, IL (US); Carlos Arrez, Berwin, IL (US); Ramiro Arrez, Orland Park, IL (US)

(73) Assignee: Perkins Manufacturing Company, LaGrange, IL (US)

( * ) Notice: Subject to any disclaimer, the term of this patent is extended or adjusted under 35 U.S.C. 154(b) by 298 days.

(21) Appl. No.: 10/718,336

(22) Filed: Nov. 20, 2003

(65) Prior Publication Data

US 2005/0111942 A1 May 26, 2005

(51) Int. Cl.
*B65F 3/02* (2006.01)

(52) U.S. Cl. ..... 414/408; 414/409; 414/421; 414/550; 414/555

(58) Field of Classification Search ..... 414/404–406, 414/408–409, 505, 501, 549, 551, 555
See application file for complete search history.

(56) References Cited

U.S. PATENT DOCUMENTS

| | | | |
|---|---|---|---|
| 1,475,483 | A | 11/1923 | Galuska |
| 1,763,499 | A | 6/1930 | Bolger |
| 2,480,959 | A | 9/1949 | Presnell |
| 2,824,658 | A | 2/1958 | Beasley |
| 3,032,216 | A | 5/1962 | McCarthy |
| 3,040,919 | A | 6/1962 | Nolan |
| 3,136,436 | A | 6/1964 | Erlinder et al. |
| 3,147,870 | A | 9/1964 | Urban et al. |
| 3,170,580 | A | 2/1965 | Soyko |
| 3,211,312 | A | 10/1965 | Miller |
| 3,270,902 | A | 9/1966 | Breault |
| 3,279,633 | A | 10/1966 | Evers |
| 3,327,876 | A | 6/1967 | Kolling |
| 3,415,169 | A | 12/1968 | Naddell |
| 3,484,006 | A | 12/1969 | Burke |

(Continued)

FOREIGN PATENT DOCUMENTS

| | | |
|---|---|---|
| AT | 243183 | 2/1965 |

(Continued)

OTHER PUBLICATIONS

Perkins Mfg. Brochure: "The Original Rotary Tuckaway," Model D6080-20K, (2 pages).

(Continued)

*Primary Examiner*—Saul J. Rodriguez
*Assistant Examiner*—Charles Greenhut
(74) *Attorney, Agent, or Firm*—Cook, Alex, McFarron, Manzo, Cummings & Mehler, Ltd.

(57) ABSTRACT

A refuse receptacle lifter is disclosed that is mounted on a transporter secured to the front end of a collection vehicle rearwardly of an associated collection container. The transporter is adapted to move the lifter in a generally side-to-side direction relative to the collection container in order to move the lifter between a retracted position and a position in which it is spaced from the collection container so that it can engage a refuse receptacle. If the collection vehicle does not have a collection container. being carried on the front of the vehicle, the lifter may be moved to stored position generally adjacent to the front end of the vehicle.

13 Claims, 8 Drawing Sheets

U.S. PATENT DOCUMENTS

| | | | | | |
|---|---|---|---|---|---|
| 3,516,562 | A | | 6/1970 | Knight | |
| 3,576,215 | A | | 4/1971 | Cline | |
| 3,576,265 | A | | 4/1971 | Brady | |
| 3,662,910 | A | | 5/1972 | Herpich et al. | |
| 3,730,365 | A | | 5/1973 | Herpich | |
| 3,732,997 | A | | 5/1973 | Reavis et al. | |
| 3,738,516 | A | | 6/1973 | Wells | |
| 3,747,785 | A | | 7/1973 | Dahlin | |
| 3,762,586 | A | * | 10/1973 | Updike, Jr. | 414/408 |
| 3,773,197 | A | | 11/1973 | Blakeley et al. | |
| 3,804,277 | A | | 4/1974 | Brown et al. | |
| 3,822,802 | A | * | 7/1974 | Evans, Jr. | 414/501 |
| 3,823,973 | A | | 7/1974 | Ramer | |
| 3,827,587 | A | | 8/1974 | Liberman et al. | |
| 3,837,512 | A | | 9/1974 | Brown | |
| 3,841,508 | A | * | 10/1974 | Ebeling et al. | 414/406 |
| 3,844,434 | A | | 10/1974 | Blakeley et al. | |
| 3,861,547 | A | | 1/1975 | Sink, Sr. | |
| 3,884,376 | A | | 5/1975 | Rivers | |
| 3,894,642 | A | | 7/1975 | Shive | |
| 3,901,255 | A | | 8/1975 | Pettit | |
| 3,931,901 | A | | 1/1976 | Jones | |
| 3,944,092 | A | | 3/1976 | Ebeling et al. | |
| 3,954,194 | A | | 5/1976 | Stedman | |
| 3,964,624 | A | | 6/1976 | Werder | |
| 3,978,999 | A | | 9/1976 | Ryder | |
| 4,034,649 | A | | 7/1977 | Harvey et al. | |
| 4,042,137 | A | | 8/1977 | Hughes et al. | |
| 4,057,156 | A | | 11/1977 | Thompson et al. | |
| 4,090,626 | A | | 5/1978 | Ebeling et al. | |
| 4,091,944 | A | | 5/1978 | Gollnick | |
| 4,096,959 | A | | 6/1978 | Schaffer | |
| 4,113,125 | A | | 9/1978 | Schiller | |
| 4,175,903 | A | | 11/1979 | Carson | |
| 4,219,298 | A | | 8/1980 | Stragier et al. | |
| 4,227,849 | A | | 10/1980 | Worthington | |
| 4,230,359 | A | | 10/1980 | Smith | |
| 4,237,857 | A | | 12/1980 | Sharp, Sr. | |
| 4,239,437 | A | | 12/1980 | Naab | |
| 4,295,776 | A | | 10/1981 | Payne et al. | |
| 4,313,707 | A | | 2/1982 | Bingman et al. | |
| 4,345,868 | A | | 8/1982 | Rizzo et al. | |
| 4,348,147 | A | | 9/1982 | Helm | |
| 4,349,305 | A | | 9/1982 | Wynn et al. | |
| 4,363,588 | A | | 12/1982 | Stickney | |
| 4,365,922 | A | | 12/1982 | Borders | |
| 4,372,726 | A | | 2/1983 | Lutz | |
| 4,401,407 | A | | 8/1983 | Breckenridge | |
| 4,422,814 | A | | 12/1983 | Borders | |
| 4,427,333 | A | | 1/1984 | Ebeling | |
| 4,435,117 | A | | 3/1984 | House | |
| 4,450,828 | A | | 5/1984 | Oaken et al. | |
| 4,461,607 | A | | 7/1984 | Smith | |
| 4,461,608 | A | | 7/1984 | Boda | |
| 4,479,751 | A | | 10/1984 | Wyman et al. | |
| 4,527,939 | A | | 7/1985 | Suarez | |
| 4,538,951 | A | | 9/1985 | Yeazel et al. | |
| 4,543,028 | A | * | 9/1985 | Bell et al. | 414/408 |
| 4,548,542 | A | | 10/1985 | Reese | |
| 4,557,658 | A | | 12/1985 | Lutz | |
| 4,566,840 | A | | 1/1986 | Smith | |
| 4,575,300 | A | | 3/1986 | George | |
| 4,597,710 | A | | 7/1986 | Kovats | |
| 4,597,712 | A | | 7/1986 | Smith | |
| 4,613,271 | A | | 9/1986 | Naab | |
| 4,647,267 | A | | 3/1987 | Hund, Jr. | |
| 4,669,940 | A | | 6/1987 | Engelhardt et al. | |
| 4,673,327 | A | | 6/1987 | Knapp | |
| 4,687,405 | A | | 8/1987 | Olney | |
| 4,699,557 | A | | 10/1987 | Barnes | |
| 4,708,570 | A | | 11/1987 | Smith et al. | |
| 4,715,767 | A | | 12/1987 | Edelhoff et al. | |
| 4,722,658 | A | | 2/1988 | Wurtz et al. | |
| 4,726,726 | A | | 2/1988 | Dossena et al. | |
| 4,741,658 | A | | 5/1988 | Zelinka et al. | |
| 4,773,812 | A | | 9/1988 | Bayne et al. | |
| 4,844,682 | A | | 7/1989 | Edelhoff | |
| 4,872,801 | A | | 10/1989 | Yeazel et al. | |
| 4,909,564 | A | | 3/1990 | Pfeifer et al. | |
| 4,911,600 | A | | 3/1990 | Zelinka et al. | |
| 4,936,732 | A | | 6/1990 | Naab et al. | |
| 4,966,514 | A | | 10/1990 | Knapp | |
| 4,983,092 | A | | 1/1991 | Richards | |
| 4,986,074 | A | | 1/1991 | Hahmann et al. | |
| 4,992,018 | A | | 2/1991 | Prout et al. | |
| 5,002,450 | A | | 3/1991 | Naab | |
| 5,007,786 | A | | 4/1991 | Bingman | |
| 5,015,142 | A | | 5/1991 | Carson | |
| 5,015,143 | A | | 5/1991 | Carson | |
| 5,018,929 | A | | 5/1991 | Carson | |
| 5,020,844 | A | * | 6/1991 | Pickrell | 294/86.4 |
| 5,024,573 | A | | 6/1991 | Redding et al. | |
| 5,026,104 | A | | 6/1991 | Pickrell | |
| 5,026,241 | A | | 6/1991 | Wyman | |
| 5,028,196 | A | | 7/1991 | Richards | |
| 5,035,563 | A | | 7/1991 | Mezey | |
| 5,045,026 | A | | 9/1991 | Buse | |
| 5,049,026 | A | | 9/1991 | Bingman et al. | |
| 5,056,979 | A | | 10/1991 | Niederer | |
| 5,069,593 | A | | 12/1991 | Zelinka et al. | |
| 5,071,303 | A | | 12/1991 | Carson | |
| 5,071,307 | A | | 12/1991 | Carson | |
| 5,088,531 | A | | 2/1992 | Wade | |
| 5,092,731 | A | | 3/1992 | Jones et al. | |
| 5,098,250 | A | | 3/1992 | Carson | |
| 5,114,304 | A | | 5/1992 | Edelhoff et al. | |
| 5,163,805 | A | | 11/1992 | Mezey | |
| 5,205,698 | A | | 4/1993 | Mezey | |
| 5,209,537 | A | | 5/1993 | Smith | |
| RE34,292 | E | | 6/1993 | Bingman et al. | |
| 5,230,393 | A | | 7/1993 | Mezey | |
| 5,257,877 | A | | 11/1993 | Zelinka et al. | |
| 5,266,000 | A | | 11/1993 | LeBlanc | |
| 5,303,841 | A | | 4/1994 | Mezey | |
| 5,308,211 | A | * | 5/1994 | Bayne | 414/408 |
| 5,333,984 | A | | 8/1994 | Bayne et al. | |
| 5,344,272 | A | | 9/1994 | Nuyts | |
| 5,360,310 | A | | 11/1994 | Jones et al. | |
| 5,391,039 | A | | 2/1995 | Holtom | |
| 5,466,110 | A | | 11/1995 | Redding | |
| 5,470,187 | A | | 11/1995 | Smith et al. | |
| 5,482,180 | A | | 1/1996 | Smith et al. | |
| 5,484,245 | A | * | 1/1996 | Zopf | 414/408 |
| 5,505,576 | A | | 4/1996 | Sizemore et al. | |
| 5,513,942 | A | | 5/1996 | Pickrell | |
| 5,551,824 | A | | 9/1996 | Zanzig et al. | |
| 5,562,386 | A | | 10/1996 | Browning | |
| 5,601,392 | A | | 2/1997 | Smith et al. | |
| 5,607,277 | A | * | 3/1997 | Zopf | 414/408 |
| 5,639,201 | A | * | 6/1997 | Curotto | 414/408 |
| 5,720,588 | A | | 2/1998 | Graves | |
| 5,720,589 | A | | 2/1998 | Christenson et al. | |
| 5,755,547 | A | * | 5/1998 | Flerchinger et al. | 414/408 |
| 5,769,592 | A | | 6/1998 | Christenson | |
| 5,775,867 | A | | 7/1998 | Christenson | |
| 5,784,947 | A | * | 7/1998 | Bayne et al. | 91/406 |
| 5,791,861 | A | | 8/1998 | Seelig | |
| 5,797,715 | A | | 8/1998 | Christenson | |
| 5,807,056 | A | | 9/1998 | Osborn et al. | |
| 5,813,824 | A | | 9/1998 | Zanzig et al. | |
| 5,826,485 | A | | 10/1998 | Bayne et al. | |
| 5,829,944 | A | | 11/1998 | Szinte | |
| 5,833,428 | A | * | 11/1998 | Szinte | 414/408 |
| 5,853,277 | A | | 12/1998 | Everhart | |

| | | | | |
|---|---|---|---|---|
| 5,890,865 | A | 4/1999 | Smith et al. | |
| 5,934,867 | A * | 8/1999 | Christenson | 414/812 |
| 5,938,394 | A * | 8/1999 | Christenson | 414/408 |
| 6,059,511 | A | 5/2000 | Anderson et al. | |
| 6,095,744 | A | 8/2000 | Harrison | |
| 6,139,244 | A * | 10/2000 | VanRaden | 414/408 |
| 6,158,945 | A | 12/2000 | Anderson | |
| 6,167,795 | B1 | 1/2001 | Bayne et al. | |
| 6,183,185 | B1 | 2/2001 | Zanzig et al. | |
| 6,293,863 | B1 | 9/2001 | Carr et al. | |
| 6,325,587 | B1 * | 12/2001 | Wysocki et al. | 414/408 |
| 6,357,988 | B1 | 3/2002 | Bayne | |
| 6,413,031 | B1 | 7/2002 | Yakley et al. | |
| 6,439,667 | B1 | 8/2002 | Weets et al. | |
| 6,503,045 | B2 | 1/2003 | Arrez et al. | |
| 6,551,046 | B1 | 4/2003 | Dorrington | |
| D488,900 | S * | 4/2004 | Grange | D34/3 |
| 7,210,890 | B2 * | 5/2007 | Curotto et al. | 414/408 |
| 2001/0046430 | A1 | 11/2001 | Bayne | |
| 2002/0119034 | A1 | 8/2002 | Arrez | |
| 2002/0141854 | A1 | 10/2002 | Arrez | |
| 2002/0141855 | A1 | 10/2002 | Arrez | |
| 2003/0099529 | A1 | 5/2003 | Arrez | |
| 2005/0095096 | A1 * | 5/2005 | Curotto et al. | 414/406 |
| 2007/0172340 | A1 * | 7/2007 | Curotto et al. | 414/408 |

FOREIGN PATENT DOCUMENTS

| | | |
|---|---|---|
| BE | 510235 | 4/1952 |
| CA | 622499 | 6/1961 |
| CH | 358747 | 1/1962 |
| CH | 453203 | 6/1968 |
| DE | 811 456 | 8/1951 |
| DE | 844 262 | 3/1952 |
| DE | 1 226 035 | 9/1966 |
| DE | 1 236 403 | 3/1967 |
| DE | 2 146 653 | 3/1967 |
| DE | 1 531 763 | 1/1970 |
| DE | 2 051 270 | 10/1970 |
| DE | 30 24 081 | 1/1981 |
| DK | 82300 | 6/1954 |
| EP | 0 078 011 | 4/1983 |
| EP | 0 312 900 | 4/1989 |
| EP | 0 405 428 A1 | 1/1991 |
| EP | 575 867 | 12/1993 |
| FR | 2 272 002 | 12/1975 |
| FR | 2 459 779 | 1/1981 |
| FR | 2 479 783 | 10/1981 |
| FR | 2 500 425 | 8/1982 |
| GB | 291709 | 6/1928 |
| GB | 2 078 196 | 1/1982 |
| GB | 2 080 757 A | 2/1982 |
| GB | 2 188 302 | 9/1987 |
| SU | 751794 | 9/1980 |
| SU | 1 253 892 | 8/1986 |
| WO | WO 83/03242 | 9/1983 |
| WO | WO 91/00231 | 1/1991 |
| WO | WO91/05721 | 5/1991 |
| WO | WO92/01612 | 2/1992 |
| WO | WO93/25457 | 12/1993 |
| WO | WO94/21540 | 9/1994 |

OTHER PUBLICATIONS

Zöller-Kipper GMBH Brochure "Zöller System," (11 pages).
Bayne Brochure Thinline® Grabber Lifter, Model GTLS 1110, undated, (2 pages).
Lifting Mechanism for a Sanitation Vehicle, U.S. Appl. No. 378,823, filed May 12, 1982, now abandoned (bearing production Nos. B984-1005), with photographs (dated Dec. 1981) (bearing production Nos. B1082-1097), photographs of a present version of the above cited reference (bearing production Nos. B1098-1110A), and other related documents (bearing production Nos. 935-937, 939, 941-947, 948-977, 979, 981, 983, 1006-1025, and 1111-1125) .
Refuse Removal Systems, Inc., "Waste Wheeler," Waste Age, 1982 (with photographs of the device bearing production Nos. B913-922).
Rubbermaid "Mobile Toter."
McKagen, World Wastes, "Supercan! Can . . . And Does," Jun. 1983, pp. 24-26.
Waste Age, Mar. 1982, pp. 31-33.
Zarn Model "D" sales brochure, printed prior to Mar. 20, 2002.
Taskmaster Lifter features/specifications from: http://www.baynethinline.com/products-taskmaster.htm.
Arrez et al., U.S. Appl. No. 10/767,041, filed Jan. 29, 2004, entitled "Heavy Duty Cart Lifter."
Arrez et al., U.S. Appl. No. 10/691,989, filed Oct. 23, 2003, entitled "Receptacle Lifter With Retractable Gripper Arms."

* cited by examiner

FRONT MOUNTED LIFTER FOR FRONT LOAD VEHICLE

The present invention relates generally to a front load refuse collection vehicle and, more particularly, to an apparatus for, and methods of, refuse collection including a receptacle lifter assembly associated with. the front end of the refuse collection vehicle for lifting and dumping the contents of the receptacle into an intermediate refuse collection container located at the front end of the vehicle, which is lifted and dumped into collection vehicle when a sufficient amount of the refuse is collected.

BACKGROUND OF THE INVENTION

Front load refuse collection vehicles are in wide use in large-scale residential refuse collection. Typically, front load refuse collection vehicle have a front crew cab, a large refuse compartment behind the cab, and a pair of hydraulic-powered lift forks extending in front of. the truck which are adapted to be inserted into corresponding slots or sleeves associated with a relatively large refuse collection container. The forks are then able to lift the refuse container over the front of the truck, invert container, and invert the container in order to dump its contents into the refuse compartment behind the cab.

For residential and small-scale refuse receptacle collection, the front load collection vehicle often carries the collection container in front of the vehicle as it moves along the street. This configuration allows the operator to dump smaller residential receptacles directly into the collection container before the containers dumped into the collection compartment of the vehicle. Typically, this has been a manual operation, with the operator parking the refuse collection vehicle near the receptacle, leaving the cab, and manually lifting and emptying the receptacle into the collection container. As can appreciated, this is unduly time consuming, labor intensive, and can lead to operator injury due to the repeated lifting of the often heavy refuse receptacles.

As a consequence, hydraulic receptacle lifters have been mounted directly to the collection container. Such collection containers with attached hydraulic lifters have been available from Perkins Manufacturing Company, assignee of the present application, since at least 1990. Other examples of collection containers with attached hydraulic lifters are disclosed in U.S. Pat. No. 5,333,984, which is incorporated by reference herein.

More recently, hydraulic lifters have been mounted on collection containers in a manner so that the lift can be mechanically moved into engagement with the refuse receptacle, rather than requiring the operator to move the refuse receptacle to the lifter, thus further reducing the labor required by the operator. Such systems are disclosed in U.S. Pat. Nos. 5,639,201 and 5,607,277, which are also incorporated by reference herein.

While the use of the systems described above has resulted in savings of time and labor, the known systems still have several deficiencies. Because hydraulic connections are typically required between the hydraulic system of the collection vehicle and the carrier-mounted lifter, these connections have been vulnerable to leakage and assorted breakdowns, requiring additional maintenance due, in part to the relatively large range of motion encountered by the container as it has moved over the cab to dump the contents thereof. The repeated lifting places additional stress of the hydraulic system and lines that has also required, in some instances, special designs to prevent the interference between the receptacle lifter and the lift forks for fork lift system of the collection vehicle.

Additionally, some of the container-mounted lifters are compatible only with a specific style of residential refuse receptacle, and are unable to handle containers of different styles. This can result in requiring several collection containers with different lifters for different collection routes, which results in added capital expense for additional equipment.

Accordingly, the primary object of the present invention is to provide an improved refuse collection vehicle and refuse receptacle lifter that results in more efficient methods of refuse collection.

A further object is to provide a refuse collection vehicle having an intermediate collection container with a refuse receptacle lifter that does not require a hydraulic connection between the vehicle and the collection container and the lifter.

Subsidiary objects are to provide a refuse receptacle lifter that can be used for lifting a variety of different style receptacles and to provide a lifter assembly that can be stored in an out-of-the-way position when not in use.

SUMMARY OF THE INVENTION

These objects, as wells as others that will become apparent upon reference to the following detailed description and accompanying drawings, are provided by an improved refuse collection vehicle, refuse receptacle lifter assembly, and combinations thereof, as well as methods of their use as set forth below. In the context of the present invention, the refuse collection vehicle includes a refuse receiving cavity, a collection container typically mounted to the front of the vehicle, and a lifter assembly. The lifter assembly comprises a refuse receptacle lifter for engaging, lifting, and inverting a refuse receptacle in order to dump its contents into the collection container. The refuse receptacle lifter is mounted on a transporter secured to the vehicle and located rearwardly of the collection container. The transporter is adapted to move the lifter in a generally side-to-side direction relative to the collection container in order to move the lifter between a retracted position and a position in which it is spaced from the collection container so that it can engage a refuse receptacle. The lifter is thus moveable in a generally linear manner from an initial position proximate to the collection container, to a second position for engaging the refuse receptacle spaced laterally from the collection container, and back to the initial position proximate to the collection container for dumping the receptacle. Because the lifter is attached to the vehicle, and not to the collection container, it is not subject to the repeated lifting required for dumping the collection container contents into the vehicle's refuse receiving cavity. Consequently, the hydraulic system is subject to less stress, and no special collection container designs are required.

In accordance with another aspect of the invention, the lifter may be moved to stored position generally adjacent. to the front end of the vehicle when the vehicle is not being used for residential or small receptacle collection. When the vehicle is used on a residential or similar route, the lifter can be easily moved to a working position spaced forwardly of the vehicle and laterally of the collection container.

As set forth in more detail below, the present invention is also embodied by a lifter assembly alone that can be attached to the front end of a front loading refuse collection vehicle. In general, such a lifter assembly may comprise a receptacle lifter for engaging, lifting, and inverting refuse receptacles, and a transporter for mounting in a generally transverse position at the front of the vehicle. The transporter carries the receptacle lifter and is moveable generally side-to-side, so as to move the lifter between a refuse receptacle engaging position and a receptacle dumping position.

BRIEF DESCRIPTION OF THE FIGURE OF THE DRAWINGS

In each of FIGS. 1-10, a refuse receptacle is knot included in order to more clearly show the inventive lifter assembly.

DETAILED DESCRIPTION

Figure 1:
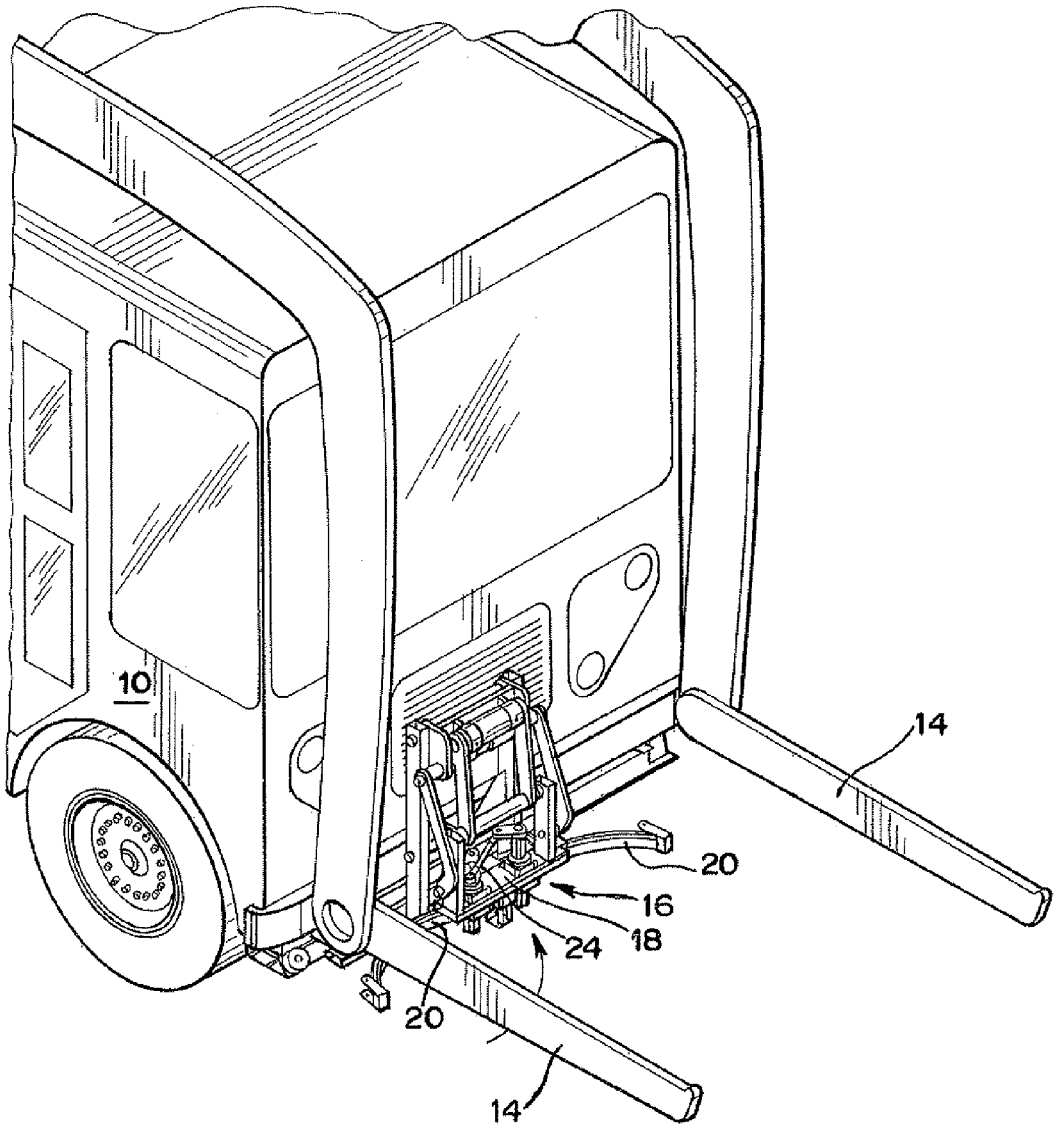
FIG. 1 is a perspective view of a front load refuse collection vehicle and refuse receptacle lifter according to the present invention in which the lifter is in its stored position.
Figure 2:
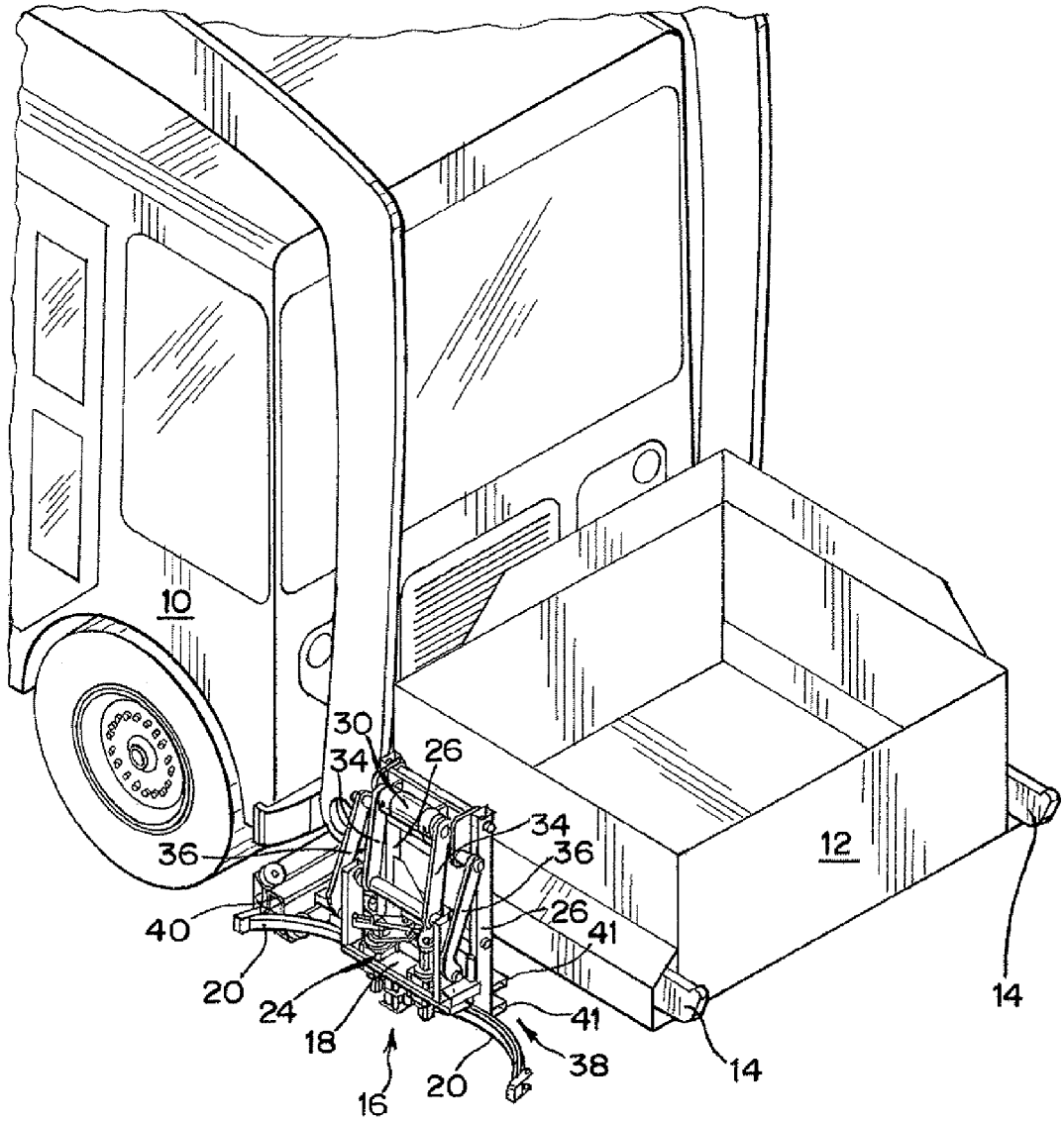
FIG. 2 is a perspective view of the refuse collection vehicle as shown in FIG. 2 in combination with a collection container and with the refuse receptacle lifter and its initial working position.
Figure 3:
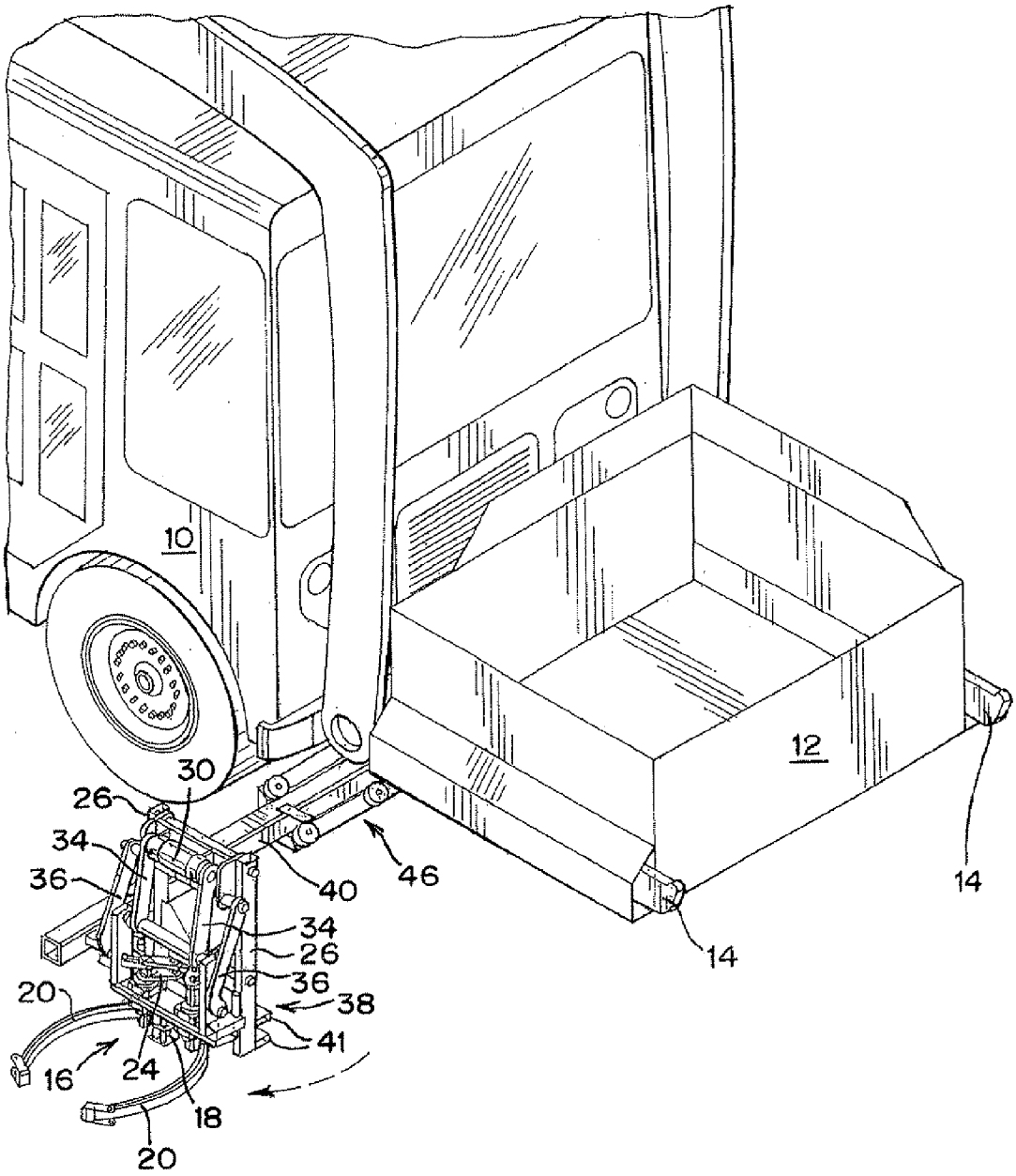
FIG. 3 is a perspective view of the refuse collection vehicle and collection container combination of FIG. 2 with a refuse receptacle lifter extended to its receptacle engaging position.

Turning to the figures of the drawings, there is seen in FIGS. 1-3 a front load refuse collection vehicle, generally designated 10, in combination with a collection container or box 12 (seen in FIGS. 2 and 3). The collection container 12 is carried on hydraulically-actuated forks 14 that move the collection container 12 from initial, refuse collection position, as shown in FIGS. 2 and 3, to an inverted position over a large refuse compartment (not shown) behind the cab of the vehicle 10 for dumping the contents thereof.

The refuse collection vehicle 10 is provided with a refuse receptacle lifter, generally designated 16, adapted to engage and invert a residential-style refuse receptacle (not shown) in order to dump its contents into the collection container 12.

The refuse receptacle lifter 16 is designed is accommodate a variety of residential roll-out refuse containers and includes a carriage 18 having a pair a pivotally-mounted lifter or grabber arms 20. The grabber arms 20 are movable between a first, open position (e.g., FIG. 4), and a second, closed position (FIG. 6) in which the grabber arms 20 are able to securely grip a refuse container for retrieving, lifting and dumping. To this end, the grabber arms 20 include tensioned straps 22 extending between the ends thereof that assist in gripping refuse containers by substantially conforming to the circumferential shape of the refuse container when the grabber arms 20 are in a closed position. An hydraulically-operated actuator mechanism, generally designated 24 moves the grabber arms between the open and closed positions. The actuator 24 will be described in greater detail below.

The carriage 18 is mounted with respect to a base structure for movement between a first, lower position (FIG. 4), for engaging refuse receptacles, and a second, inverted position (FIG. 7), for dumping refuse receptacles. The base structure is typically fabricated. from steel tubing and plate and, as illustrated, includes a pair of spaced upright members 26 and a base plate 28. The base plate 28 supports an hydraulic motor or actuator 30 having a generally horizontal rotary actuator shaft 32. On each end of the shaft 32, one end of a lift arm 34 is mounted for rotation therewith, the other end of each lift arm 34 being pivotally mounted to the upper portion of the carriage 18. A pair of follower arms 26 are provided, with one end of each follower arm 36 being pivotally mounted to the lower portion of the carriage 18 and the other end of each follower arm 36 being pivotally mounted to the upper end of the base structure. As is well known, the axes of the lift arms 34 and the follower arms 36 are displaced so as to rotate the carriage 18 as it is inverted to the dumping position.

In keeping with one aspect of the invention, the lifter 16 is mounted to the front end of the collection vehicle 10 (rather than to, e.g., the collection container), so as to be movable between a first, stored position adjacent to the front end of the vehicle 10 (as shown in FIG. 1), to a second, working position forward of the vehicle 10 and adjacent a side of the collection container 12 (as shown in FIG. 2). Thus, when not in use, the lifter 16 may be conveniently retracted to the stored position so as to not interfere with the operation of the refuse collection vehicle 10.

To this end, the receptacle lifter 16 is mounted to a support member, generally indicated by 38, typically fabricated from steel tubing and plate that is pivotally mounted to a beam or extension member 40 in the form of a square tube slidingly secured to the front of the vehicle 10 (as will be discussed in greater detail below).

Figure 5:
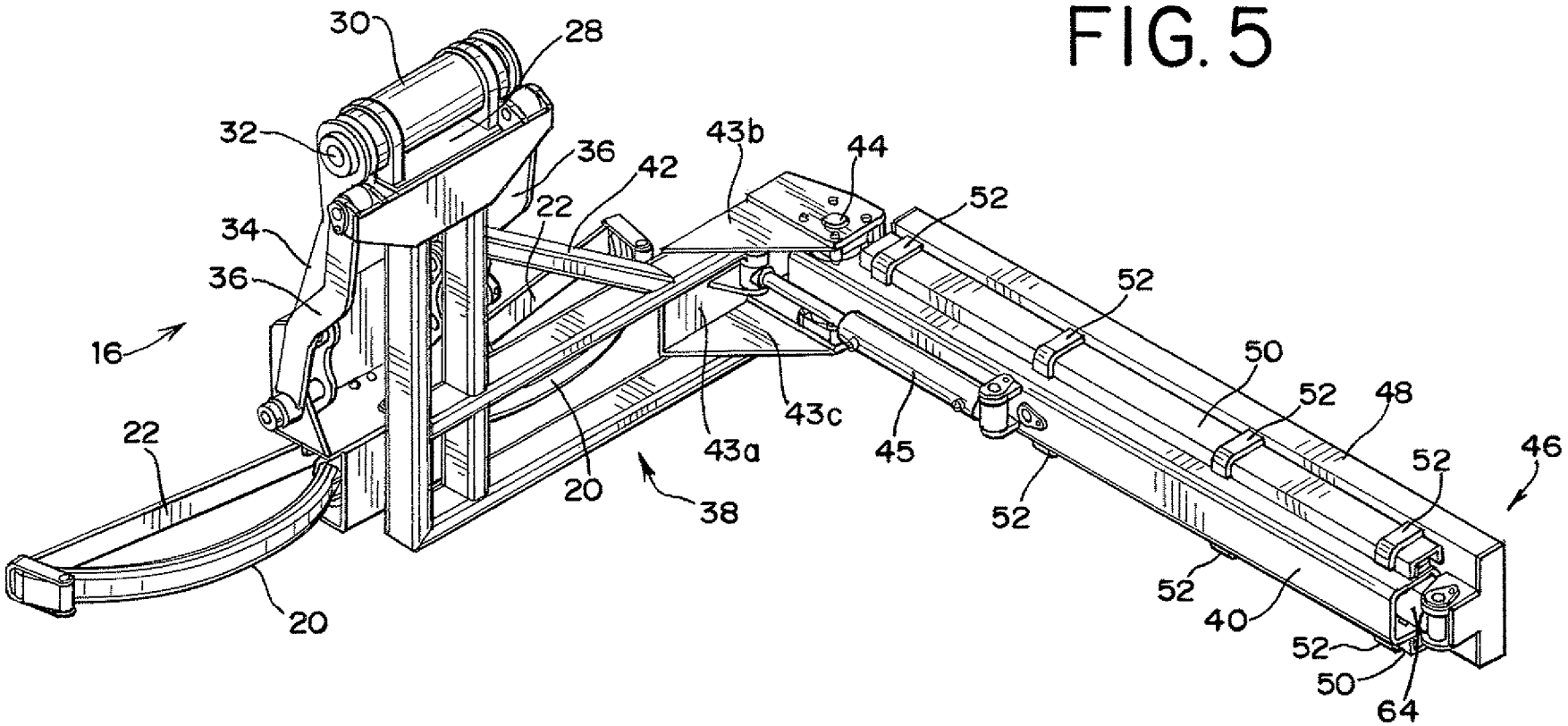
FIG. 5 is a perspective view of the refuse receptacle lifter according the present invention with the lifter in its initial working position from a reverse perspective as compared to FIG. 4.

As best seen in FIG. 5, the support member 38 comprises a pair of spaced-apart, horizontally-oriented steel beams 41, each having a generally rectangular cross-section. The spaced upright members 26 of the receptacle lifter are secured by welding to the outboard ends of the beams 41. Rigidity of the attachment is enhanced by a diagonal brace 42 between the upper beam 41 and the inboard upright member 26. The brace 42 is also preferably made from a steel beam similar in structure to the beams 41. The inboard end of the support member 38 is reinforced with a series of steel plates 43*a-c* on the face and top and bottom of the support member 38. The top and bottom plates 43*b*, 43*c* support the pivot 44 that movably secures the support member 38 to the beam 49.

To move the support member 38 and lifter 16 between the stored position (FIG. 1) and the working position (FIGS. 2, 4 and 5), an hydraulic cylinder 45 is provided that has the cylinder pivotally connected to the beam or slide tube 40 and the rod pivotally connected to the support member 38. As is readily understood, extension and retraction of the rod moves the support member 38 and lifter 16 between the working and stored positions. Of course, other configurations for the structure of the pivoting support member 38 may be used without departing from the scope of the invention, such alternative structures being a function of design choice well within the ordinary skill in the art.

In keeping with another aspect of the invention, the lifter 16 is movable from its working position to a position spaced laterally from the collection container 12 (FIG. 3), to engage and grab a refuse receptacle, and then move back to the working position (FIG. 2) with the refuse receptacle. The lifter 16 can then move to an inverted position (as seen in FIG.

Figure 4:
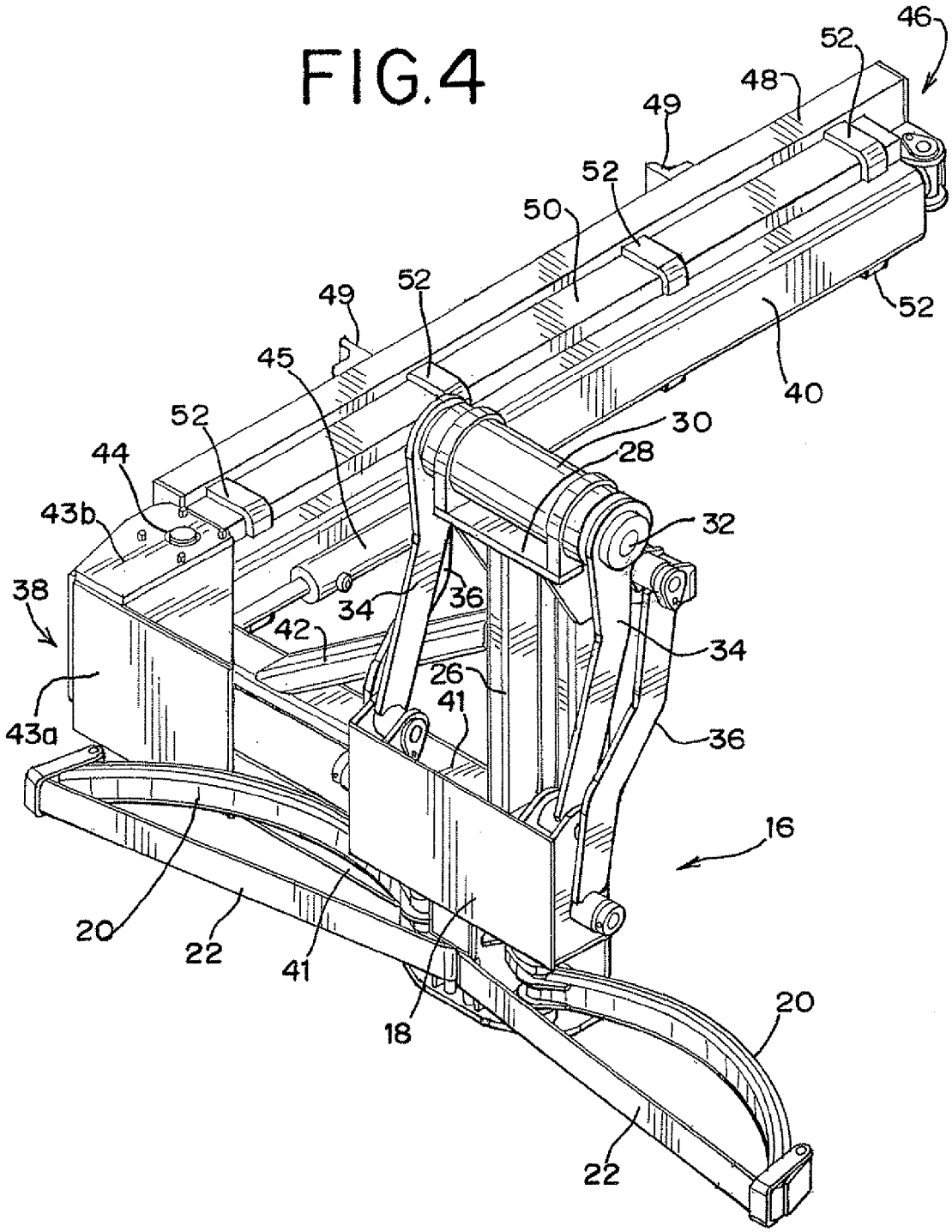
FIG. 4 is a perspective view of the refuse receptacle lifter according to the present invention with the lifter in its initial working position.

7) to dump the contents of the refuse receptacle into the collection container 12. (The terms "working position" and "receptacle dumping position" may be used interchangeably, and both refer to the position of the lifter 16 as shown in FIGS. 2, 4 and 5).

To this end, the beam 40 is mounted with respect to the front end of the vehicle 10 on a track member, generally designated 46, so as to be movable generally linearly in the direction of the longitudinal axis of the beam 40 between the retracted position, (FIGS. 1, 2, 4, 5 and 7), and the extended position (FIGS. 3 and 6), for engaging and picking up a refuse receptacle.

Figure 6:
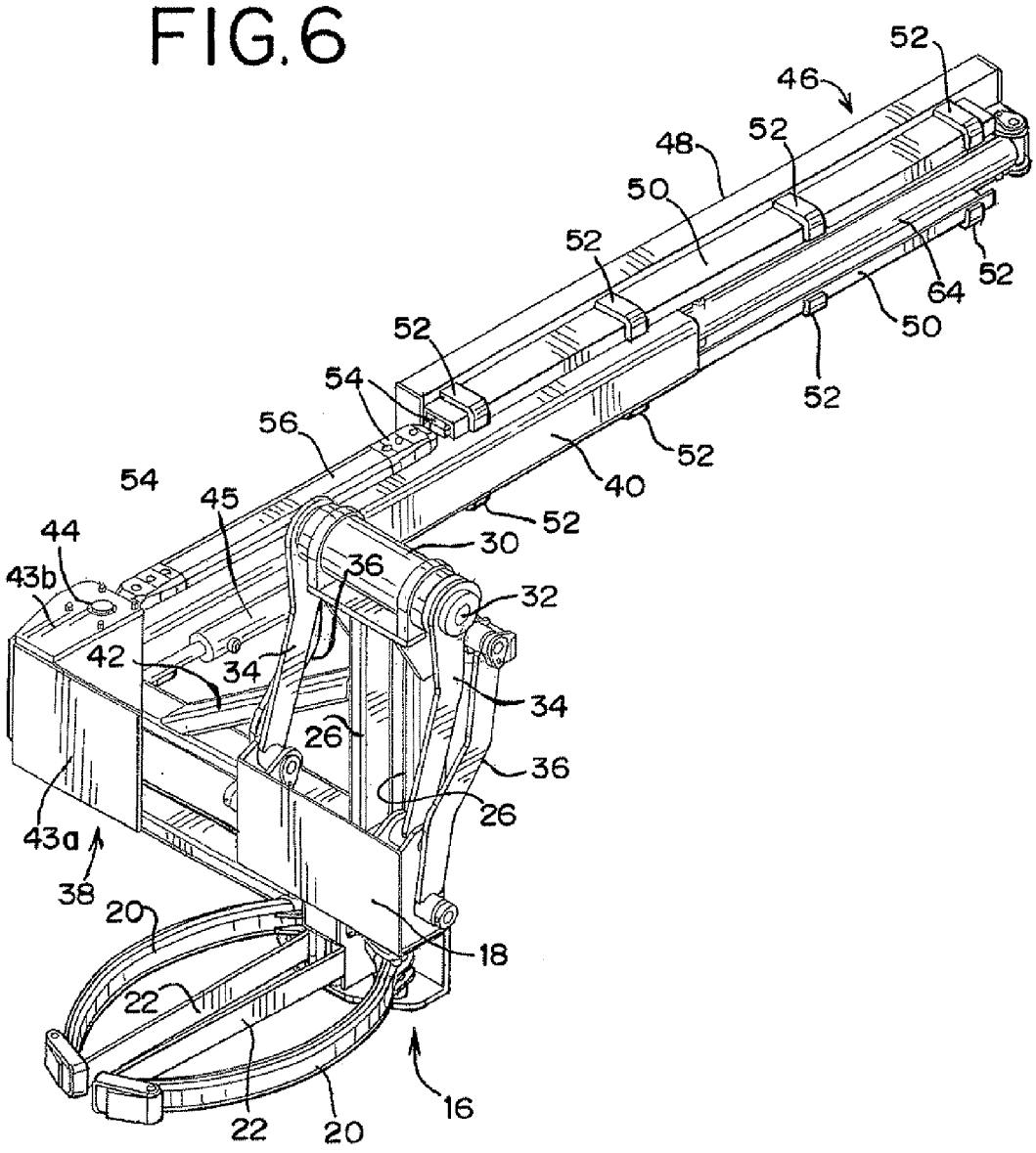
FIG. 6 is a perspective view of the refuse receptacle lifter according to the present invention with the lifter extended to its receptacle engaging position.
Figure 7:
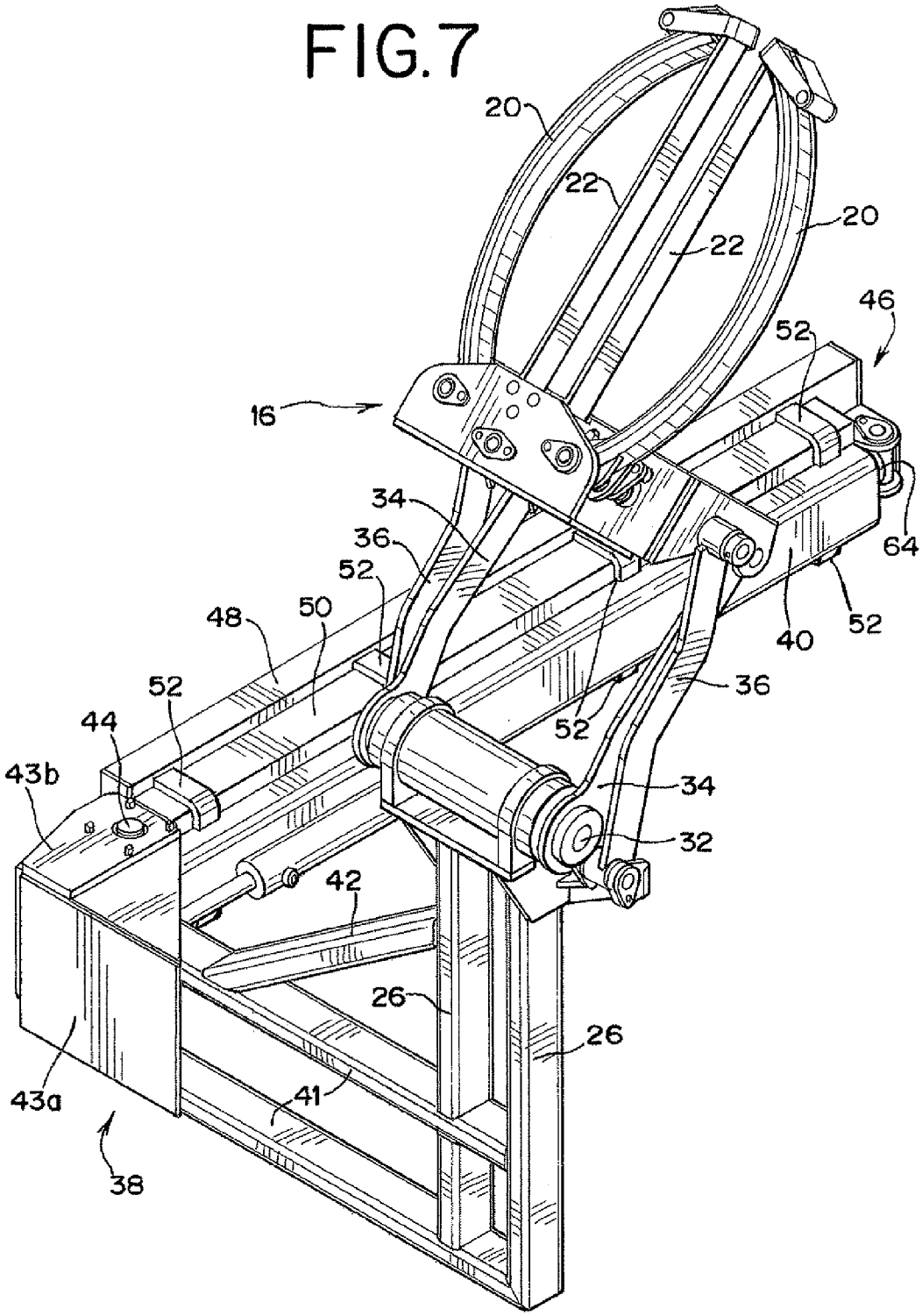
FIG. 7 is a perspective view of the refuse receptacle lifter according to the present invention with the lifter retracted to its initial working position, as shown in FIGS. 2 and 4, but with the lifter inverted to a receptacle dumping position.

As best seen in FIG. 6, the track member 46 comprises a base member 48 that is secured to the front of the vehicle 10 by means of a pair of brackets 49. Upper and lower C-channels are secured to the base member 48 by, e.g., welding, with the open faces of the C-channels 50 disposed so that they face towards each other. Brackets 52 may be provided for additional structural support for the C-channels 50 with respect to the base member 48. The slide tube 40 includes a series of eight high-density plastic blocks 54 on its top and bottom that are captured in the openings of the C-channels 50 in order to slidingly support the beam 40 with respect thereto. Preferably, the plastic blocks 54 are made from a composite plastic known as Ultra Comp 300, available from Tri-State Plastics Corp. of Charlotte, N.C. To ensure that the beam or slide tube 40 does not come out of the track member 46 if, for some reason, the blocks 54 fail, additional C-channels 56 are secured to the top and bottom of the slide tube 40 so as to also be captured within the C-channels 50. However, as can be readily appreciated, the C-channels 56 have a profile that is lower than that of the plastic blocks 54 so as to not engage the C-channels 50 under normal operating conditions, but only upon failure of the blocks 54.

To move the beam 40 between the retracted and extended positions, an hydraulic cylinder 64 is provided that has one end secured to the track member 46 and the other end secured to the beam 40. In practice, the cylinder has a throw of approximately 5 feet or 60 inches so as to permit lateral movement of the lifter of 5 feet between its retracted and extended positions. Again, other configurations for the structure of the track member 46 may be used without departing from the scope of the invention, such alternative structures being a matter of design choice well within the ordinary skill of the art.

The operation of the mechanism described above should be self-evident from the drawings. If the collection container 12 is to be carried by the forks 14 of the collection vehicle 10, the lifter 16 is pivoted away from the front of vehicle to the position shown in FIG. 2. In this position, the lifter is adjacent the curb side of the collection container 12. The collection vehicle is driven along its route. As it approaches a residential refuse receptacle, the vehicle 10 is stopped and the transporter beam extended to move the lifter laterally away from the collection container 12 and toward the refuse receptacle. When the lifter is sufficiently close to the refuse receptacle, the grabber arms 20 close so as to firmly grip the refuse receptacle. The transporter beam is then retracted to move the lifter and refuse receptacle to the dumping position (as shown in. FIG. 2). The lifter then inverts the refuse receptacle to dump its contents into the collection container 12. After returning the refuse receptacle to the upright position, the lifter may release the refuse receptacle or the transporter beam may extend so that the refuse receptacle is returned to its original position before being released by the lifter.

Figure 8:
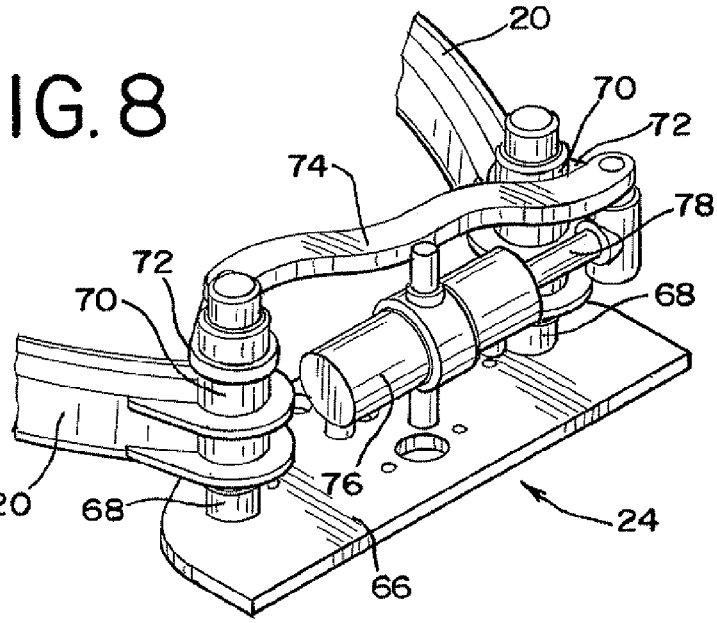
FIG. 8 is an enlarged perspective view of an actuator mechanism for use in the present invention that moves grabber arms for engaging a refuse receptacle between open and closed positions.
Figure 9:
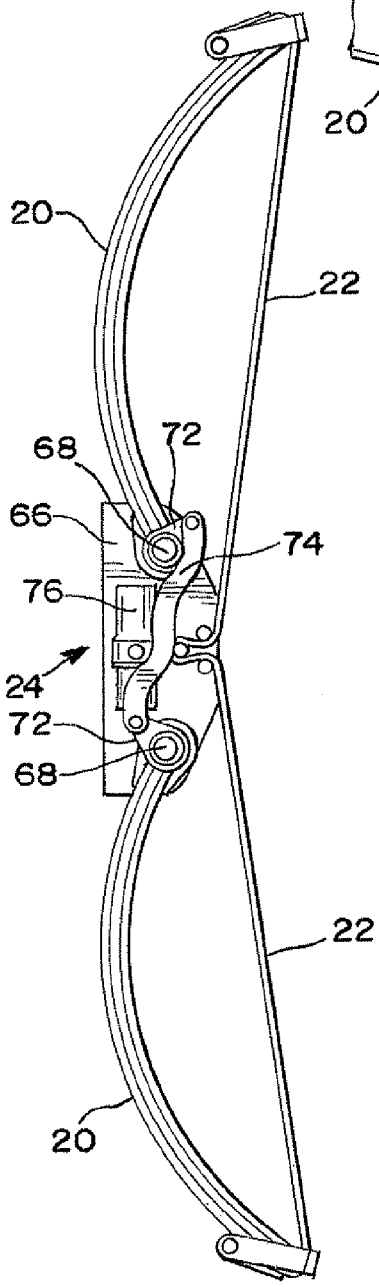
FIG. 9 is a top view of the actuator mechanism of FIG. 8 showing the grabber arms in the open position.
Figure 10:
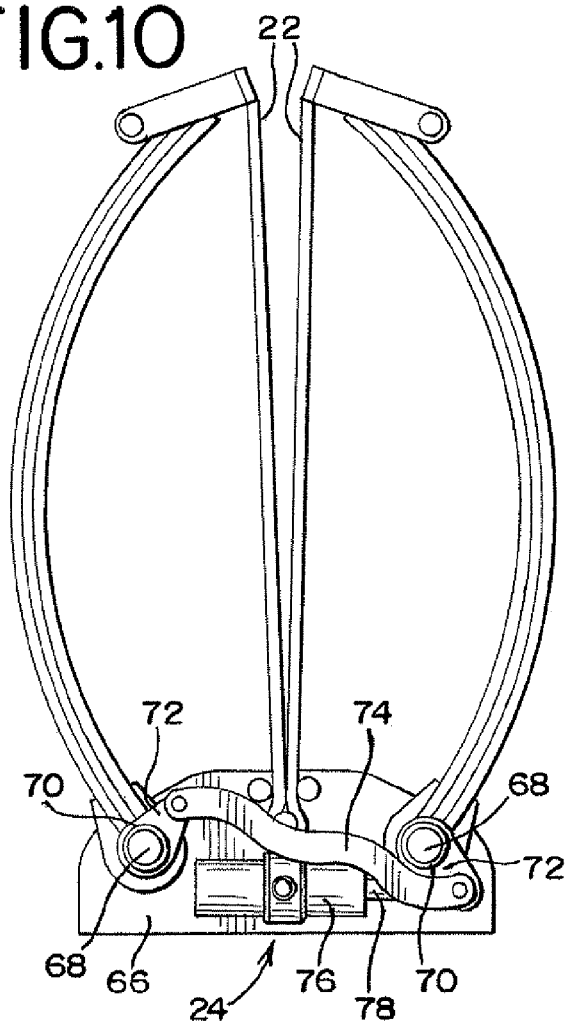
FIG. 10 is a top view of the actuator mechanism of FIG. 8 showing the grabber arms in the closed position.

The actuator mechanism 24 for the grabber arms 20 of the lifter may take any of the number of different configurations. A preferred embodiment for the actuator mechanism is shown in FIGS. 8-10. The actuator 24 moves the grabber arms 20 between the open position (FIG. 9) and the closed position (FIG. 10). To this end, each grabber arm 24 is pivotably mounted to a plate 66 that is secured to the lifter support member 38. The pivot comprises a post 68 secured to the plate 66 that receives a sleeve 70 that is integral with the end of each grabber arm 20. Each sleeve 70 has a crank arm 72 affixed thereto, the crank arms 72 being pivotally connected to each other by means of a serpentine link 74. A double-acting hydraulic cylinder 76 is mounted to the plate 66 and has its piston rod 78 pivotably connected to one of the crank arms 72. Thus, by actuation of the hydraulic cylinder 76, the piston rod 78 may be extended to close the grabber arms (FIG. 10) or retracted to open the grabber arms (FIG. 9).

Accordingly, the front mounted lifter and collection method have been disclosed that meets all the objects of the present invention. While the invention has been described in terms of certain preferred embodiments and method, there is no intent to limit the invention to the same. Instead, the invention is defined by the following claims.

What is claimed:

1. A refuse receptacle lifter assembly adapted for attachment to the front end of front load refuse collection vehicles having a pair of spaced-apart lift forks that are adapted to carry a collection container having a front face, a rear face, opposed sides, and an upper edge defining a generally open top forward of the vehicle for the accumulation of a quantity of refuse before dumping into a collection cavity in the vehicle, the lifter assembly comprising:

(a) a receptacle lifter for engaging, lifting and inverting refuse receptacles; and (b) a transporter adapted to be mounted at the front of the vehicle, the transporter including a carrier comprising a base member fixedly mounted to the front of a cab of the vehicle at a location behind the rear face of the collection container and below the upper edge thereof, and an elongated structure movably carried by the base member and having a first end portion with a lifter support mounted thereto to which the receptacle lifter is secured, the structure being movable substantially laterally between an extended pickup position in which the first end portion of the structure extends substantially beyond a side of the vehicle to said extended pick-up position to allow the lifter to engage curbside refuse receptacles and a retracted dumping position in which the lifter is located in proximity to one side of the collection container for dumping refuse from the refuse receptacle thereinto, said lifter support being movably attached to said structure so that said lifter support and said receptacle lifter are movable between a stored position generally adjacent to the front end of the vehicle substantially between the lift forks and an operating position spaced forwardly of the vehicle and laterally of the collection container, said lifter support being positioned generally adjacent to said structure when said receptacle lifter is in the stored position and extending generally forwardly from said carrier when said receptacle lifter is in the operating position.

2. The refuse receptacle lifter assembly of claim 1, wherein said carrier comprises an hydraulic cylinder interposed between the base member and the beam for moving the lifter assembly between the pickup and dumping positions.

3. The refuse receptacle lifter assembly of claim 2 wherein the base member further comprises an elongated tubular member that receives the sliding member therein.

4. The refuse receptacle lifter assembly of claim 1 wherein said lifter support member further comprises a pair of spaced-apart, horizontally oriented beams having an outboard end to which the receptacle lifter is secured and inboard end by which the lifter support member is pivotally secured to the carrier, and an hydraulic cylinder interposed between the carrier and lifter support member for moving the receptacle lifter between the stored and operating positions.

5. A refuse collection system comprising:

(a) a refuse collection vehicle including a front end, a rear end, two opposed sides, a pair of spaced-apart lift forks, and a refuse receiving cavity;

(b) a collection container adapted to be carried by the lift forks having a front face, a rear face, opposed sides and an upper edge defining a generally open top; and (c) a lifter assembly carried by said vehicle at the front end of a cab of the vehicle comprising:

(i) a refuse receptacle lifter for engaging, lifting, and inverting a refuse receptacle to dump the contents of the refuse receptacle into a collection container; and (ii) a transporter located at the front end of said vehicle, said transporter including a carrier comprising a base member fixedly mounted to the front of the vehicle at a location behind the rear face of the collection container and below the upper edge thereof and an elongated structure movably carried by the base member and having a first end portion with a lifter support mounted thereto to which the receptacle lifter is secured, the structure being movable substantially laterally between a receptacle pick-up position in which the first end portion of the structure extends substantially beyond a side of the vehicle to allow said lifter to engage curbside refuse receptacles and a retracted position in which the lifter is located in proximity to one side of the collection container for dumping refuse from the refuse receptacle thereinto, said carrier comprising an hydraulic cylinder operatively associated with the base member and the structure for moving the carrier between the pickup and retracted positions, said transporter further comprising the lifter support being pivotally attached to said structure so that said receptacle lifter is movable between a stored position generally adjacent to the front end of the vehicle substantially between the lift forks and an operating position spaced forwardly of the vehicle and laterally of the collection container whereby said lifter assembly may be used to engage, lift and dump contents of curbside refuse receptacles into a front loaded collection container.

6. A refuse receptacle lifter assembly adapted for attachment to front end of front load refuse collection vehicles having a pair of spaced-apart lift forks adapted to carry a collection container having a front face, a rear face, opposed sides, and an upper edge defining a generally open top forward of the vehicle for the accumulation of a quantity of refuse before dumping into a collection cavity in the vehicle, the lifter assembly comprising:

(a) a receptacle lifter for engaging, lifting and inverting refuse receptacles;

(b) a transporter adapted to be mounted at the front of the vehicle carrying the receptacle lifter, said transporter comprising a base member adapted to be fixedly mounted to the front of a cab of the vehicle at a location behind the rear face of the collection container and below the upper edge thereof, and an elongated structure movably carried by the base member and having a first end portion with a lifter support mounted thereto to which the receptacle lifter is secured, the lifter support being movably attached to the front end of the vehicle for moving said receptacle lifter between a stored position generally adjacent to the front end of the vehicle and an operating position extending generally forwardly of the vehicle and laterally of one side of the collection container, said lifter support being positioned generally adjacent to the front end of the vehicle substantially between the lift forks when said receptacle lifter is in the stored position and generally forwardly from the front end of the vehicle and generally perpendicular to the structure when said receptacle lifter is in the operating position.

7. The refuse receptacle lifter assembly of claim 6, wherein said lifter support member further comprises a pair of spaced-apart, horizontally oriented beams having an outboard end to which the receptacle lifter is secured and an inboard end by which the lifter support member is pivotally secured to the carrier, and an hydraulic cylinder interposed between the carrier and lifter support member for moving the receptacle lifter between the stored and operating positions.

8. A refuse collection vehicle comprising:

(a) a front end, a rear end, two opposed sides, a pair of spaced-apart lift forks adapted to carry a collection container having a front face, a rear face, opposed sides, and an upper edge defining a generally open top, and a refuse receiving cavity;

(b) a lifter assembly carried by said vehicle at the front end thereof comprising:

(i) a refuse receptacle lifter for engaging, lifting, and inverting a refuse receptacle to dump refuse from the refuse receptacle into a collection container; and (ii) a transporter located at the front end of said vehicle, said transporter comprising a base member adapted to be fixedly mounted to the front of a cab of the vehicle at a location behind the rear face of the collection container and below the upper edge thereof, and an elongated structure movably carried by the base member and having a first end portion with a litter support mounted thereto to which the receptacle lifter is secured, the lifter support being movably attached to the front end of the vehicle for moving said receptacle lifter between a stored position generally adjacent to the front end of the vehicle substantially between the lift forks and an operating position generally perpendicular to the structure spaced forwardly of the vehicle and laterally of the collection container, said lifter support being positioned generally adjacent to the front end of the vehicle when said receptacle lifter is in the stored position and generally forwardly from the front end of the vehicle and generally perpendicular to the structure when said receptacle lifter is in the operating position.

9. The refuse collection vehicle of claim 8, wherein said lifter support member further comprises a pair of spaced-apart, horizontally oriented beams having an outboard end to which the receptacle lifter is secured and an inboard end by which the lifter support member is pivotally secured to the carrier, and an hydraulic cylinder interposed between the carrier and lifter support member for moving the receptacle lifter between the stored and operating positions.

10. A refuse receptacle lifter assembly adapted for attachment to the front end of front load refuse collection vehicles having a pair of spaced-apart lift forks adapted to carry a collection container having a front face, a rear face, opposed sides, and an upper edge defining a generally open top forward of the vehicle for the accumulation of a quantity of refuse before dumping into a collection cavity in the vehicle, the lifter assembly comprising:

(a) a receptacle lifter for engaging, lifting and inverting refuse receptacles;

(b) a transporter adapted to be mounted in a generally transverse position at the front of a cab of the vehicle, the transporter including a carrier comprising a base member fixedly mounted to the front of the vehicle at a location behind the rear face of the collection container and below the upper edge thereof, and an elongated structure movably carried by the base member and having a first end portion with a lifter support mounted thereto to which the receptacle lifter is secured, the structure being and movable substantially laterally between an extended pick-up position in which the first end portion of the structure extends substantially beyond a side of the vehicle to allow the lifter to engage a curbside refuse receptacle and a retracted position in which the lifter is located in proximity to one side of the collection container for dumping refuse from the refuse receptacle thereinto; said lifter support being movably attached to said structure for moving between a stored position generally adjacent to the front end of the vehicle substantially between the lift forks and an operating position extending generally forwardly of the vehicle and laterally of the collection container.

11. The refuse receptacle lifter assembly of claim 10, wherein said carrier comprises an hydraulic cylinder interposed between the housing member and the sliding member for moving the lifter assembly between the pickup and dumping positions.

12. The refuse receptacle lifter assembly of claim 11 wherein the base member further comprises an elongated tubular member that receives the beam therein.

13. The refuse receptacle lifter assembly of claim 10, wherein said lifter support member further comprises a pair of spaced-apart, horizontally oriented beams having an outboard end to which the receptacle lifter is secured and an inboard end by which the lifter support member is pivotally secured to the carrier, and an hydraulic cylinder interposed between the carrier and lifter support member for moving the receptacle lifter between the stored and operating positions.

* * * * *